US006560313B1

(12) United States Patent
Harding et al.

(10) Patent No.: US 6,560,313 B1
(45) **Date of Patent: *May 6, 2003**

(54) MONOCHROMATIC X-RAY SOURCE

(75) Inventors: Geoffrey Harding, Hamburg (DE); Bernd Ulmer, Hamburg (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 09/713,877

(22) Filed: Nov. 16, 2000

(30) Foreign Application Priority Data

Nov. 18, 1999 (DE) ..... 199 55 392

(51) Int. Cl.[7] ..... H01J 35/08
(52) U.S. Cl. ..... 378/143; 378/124; 378/44
(58) Field of Search ..... 378/124, 143, 378/121, 119, 44, 45

(56) References Cited

U.S. PATENT DOCUMENTS 3,867,637 A 2/1975 Braun et al. ..... 250/503
3,894,239 A * 7/1975 Braun ..... 378/125
3,919,548 A * 11/1975 Porter ..... 378/45
4,048,496 A * 9/1977 Albert ..... 378/45
4,723,262 A * 2/1988 Noda et al. ..... 378/119
4,953,191 A * 8/1990 Smither et al. ..... 378/143
6,185,277 B1 * 2/2001 Harding ..... 378/143

* cited by examiner

*Primary Examiner*—Robert H. Kim

(57) ABSTRACT

The invention relates to an X-ray source for generating substantially monochromatic fluorescent X-rays by means of a primary and a secondary target. The radiation source is characterized in that the primary target (10) is a liquid metal or a liquid metal alloy which is conducted between a first window (2) which is transparent to an electron beam and a second window (6) which is transparent to X-rays and is adjoined by the secondary target (11) in such a manner that the electrons which are incident on the primary target via the first window produce X-rays which have a maximum energy which corresponds essentially to an absorption edge of the secondary target when they reach the secondary target, so that substantially monochromatic fluorescent X-rays are excited in the secondary target.

5 Claims, 4 Drawing Sheets

MONOCHROMATIC X-RAY SOURCE

BACKGROUND OF THE INVENTION

1. Field of the Invention

The invention relates to an X-ray source for generating substantially monochromatic fluorescent X-rays with a primary and a secondary target.

2. Description of the Related Art

An X-ray source of this kind is known from U.S. Pat. No. 3,867,637 and includes, accommodated in an X-ray tube, essentially a (primary) target which faces a cathode and in which X-rays are produced by the incidence of an electron beam. The target bears on a substrate which may be made, for example of a light metal such as aluminum or beryllium and serves for mechanical support of the target and for ensuring vacuumtight sealing of the X-ray tube. The substrate is essentially transparent to the X-rays emanating from the target and is chosen to be so thick that all incident electrons are absorbed. On the other side of the substrate there is provided a fluorescent material (secondary target) which may be, for example cerium oxide, so that the X-rays that are incident from the primary target excite material-dependent monochromatic fluorescent X-rays.

A problem encountered in such known X-ray sources consists in that it is comparatively difficult to couple a large part of the X-rays generated in the primary target into the secondary target. Consequently, the intensity of the excited monochromatic fluorescent X-rays is also low or can be increased only by modification of the target at the expense of the spectral purity.

SUMMARY OF THE INVENTION

Therefore, it is an object of the invention to provide an X-ray source of the kind set forth whereby essentially monochromatic fluorescent X-rays can be generated with a high radiation intensity and at the same time a high spectral purity.

This object is achieved by means of an X-ray source of the kind set forth which is characterized in that the primary target is a liquid metal or a liquid metal alloy which is conducted between a first window, being transparent to an electron beam, and a second window, being transparent to X-rays and adjoined by the secondary target, in such a manner that electrons which are incident on the primary target via the first window produce X-rays which exhibit, upon reaching the secondary target, essentially a maximum energy which corresponds to an absorption edge of the secondary target so that substantially monochromatic fluorescent X-rays are excited in the secondary target.

The (at least in the operating condition of the X-ray source) liquid metal or the metal alloy serves not only as a primary target, but at the same time provides effective dissipation of heat from the target and also cools the windows; a comparatively strong development of heat occurs notably at the first window due to the incident electron beam. As a result of the cooling, the electron incidence and hence the thermal power density can be significantly increased, so that the radiation intensity of the monochromatic fluorescent X-rays is increased accordingly.

The dependent claims disclose advantageous further embodiments of the invention. The embodiment of the windows as disclosed in claim 2 offers the advantage that on the one hand these windows are particularly stable so that they are capable of withstanding the streaming pressure of the flowing liquid metal even when they have a comparatively small thickness whereas on the other hand they extract only a very small amount of energy from the electron beam or the X-ray beam.

The embodiment disclosed in claim 3 offers the advantage that particularly effective dissipation of heat from the windows is achieved.

Finally, the embodiment disclosed in the claims 4 and 5 offers a substantial enhancement of the spectral purity of the X-rays coupled out from the secondary target.

BRIEF DESCRIPTION OF THE DRAWINGS

Further details, features and advantages of the invention will become apparent from the following description of a preferred embodiment which is given with reference to the drawing. Therein.

DETAILED DESCRIPTION OF THE PREFERRED EMBODIMENTS

Figure 1:
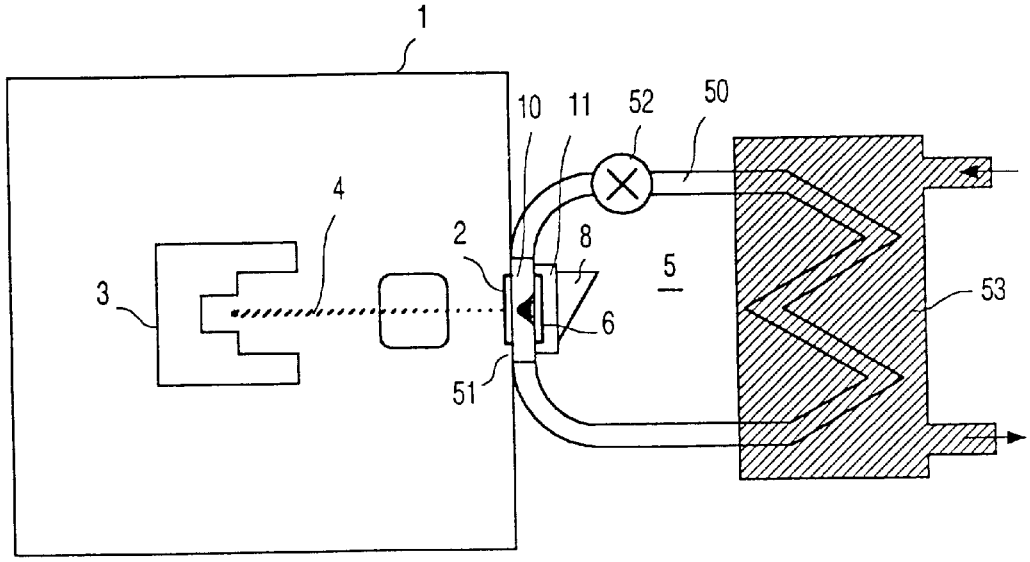
FIG. 1 shows diagrammatically an embodiment.

FIG. 1 shows a tube envelope 1 which is preferably electrically grounded and sealed in a vacuumtight manner by a first window 2. In the vacuum space of the tube envelope there is arranged a cathode 3 which emits an electron beam 4 in the operating condition, which electron beam is incident, via the first window 2, on a primary target 10 in the form of a liquid metal, so that X-rays are produced by interaction with the electrons. The liquid metal (or the liquid metal alloy) is contained in a system 5. This system includes ducts 50 wherethrough the liquid metal is driven by a pump 52, a section 51 thereof being situated opposite the first window 2, and also includes a heat exchanger 53 which is capable of dissipating, by way of a cooling circuit, the heat developed in the liquid metal.

At the side which faces the first window 2 the section 51 is provided with a second window 6 via which the X-rays excited in the liquid metal (primary target) are incident on a secondary target 11 so as to excite monochromatic fluorescent X-rays therein. Finally, this radiation is coupled out via a device 8 which adjoins the secondary target.

The first window 2 serves to provide vacuumtight sealing of the tube envelope 1 as well as the segment 51 which is traversed by the liquid metal. The first window should, moreover, be made of a material which is as transparent as possible to the electron beam so as to minimize the energy loss of the electrons during the passage of the window, and hence also the heat developed. The window should also have an as high as possible thermal conductivity.

It has been found that diamond is a very suitable material, because it offers adequate mechanical stability already in the case of a window thickness of 1 $\mu$m. The energy loss experienced in such a window by the electrons of an energy of, for example 150 keV is less than 1%, so that the heat flux produced by the electrons in the window is less than 500 W when the liquid metal is heated by the electrons with 50 kW.

Further advantages of diamond reside in its high thermal conductivity as well as in the fact that in an oxygen-free environment it can be heated up to 1500° C. without incurring irreversible modifications.

The pump 52 preferably operates in conformity with the magneto-hydrodynamic principle, so that it does not include mechanically moved parts. An example of such a pump is disclosed in U.S. Pat. No. 4,953,191.

Figure 2:
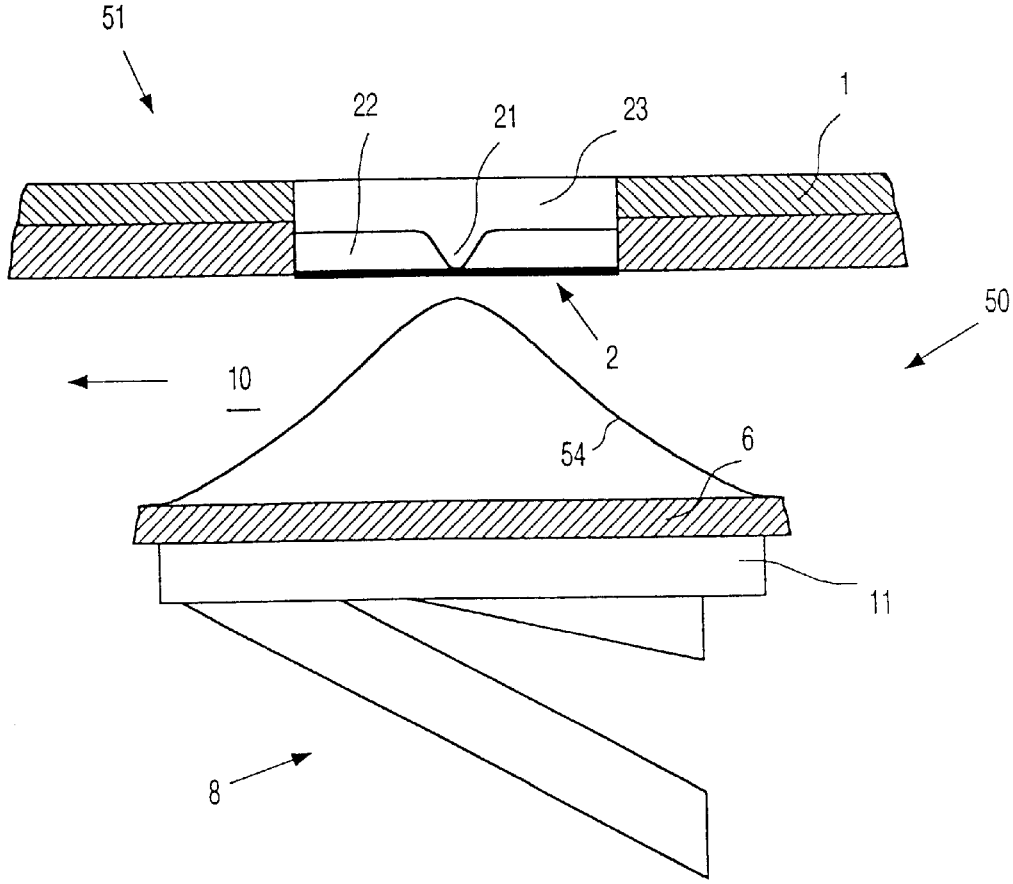
FIG. 2 shows diagrammatically a part of the X-ray source.

FIG. 2 shows the area of the section 51 of the system 5 with the first window 2, which includes a silicon substrate 22 of a thickness of, for example 300 $\mu$m as well as a diamond layer 23 of a thickness of, for example 100 $\mu$m; an opening 21 is provided in the silicon substrate at the area of passage of the electron beam. The manufacture of such a window is described, for example, in EP-A-0 957 506.

The second window 6 of the section 51 which faces the first window 2 is preferably constructed in the same way as the first window. It is important that it is suitably transparent to the X-rays excited in the liquid metal. It has been found once more that diamond is an attractive material for this purpose, because it has not only a high thermal conductivity but also a very low absorption for the X-rays generated in the target, since it may be very thin because of its strength on the one hand and has a low atomic number on the other hand.

Finally, the secondary target 11 with the diaphragm device 8 is arranged on the second window 6 as will be described in detail hereinafter with reference to FIG. 4. In order to enhance the effectiveness of the heat dissipation by the liquid metal, a constriction 54 is formed in the cross-section at the area of the windows 2, 6 of the section 51, which constriction accelerates and produces turbulence in the flow at this area. The constriction of the cross-section is, for example, asymmetrical as shown and has a cross-sectional profile which is similar to that of an airfoil; the free passage for the liquid metal may then be approximately 100 microns in relation to a diameter of the duct 50 of approximately 10 mm. Furthermore, the constriction 54 and the second window 6 are preferably made of the same material and constitute one element performing both functions.

For the primary target use can be made of metals or metal alloys which have a high atomic number and are liquid at an as low as possible temperature, preferably room temperature. Examples in this respect are mercury, a metal alloy of 62.5% Ga, 21.5% In and 16% Sn or a metal alloy of 43% Bi, 21.7% Pb, 18.3% In, 8% Sn, 5% Cd and 4% Hg (all values stated in percents by weight). The secondary target may be made, for example, of tantalum.

Figure 3:
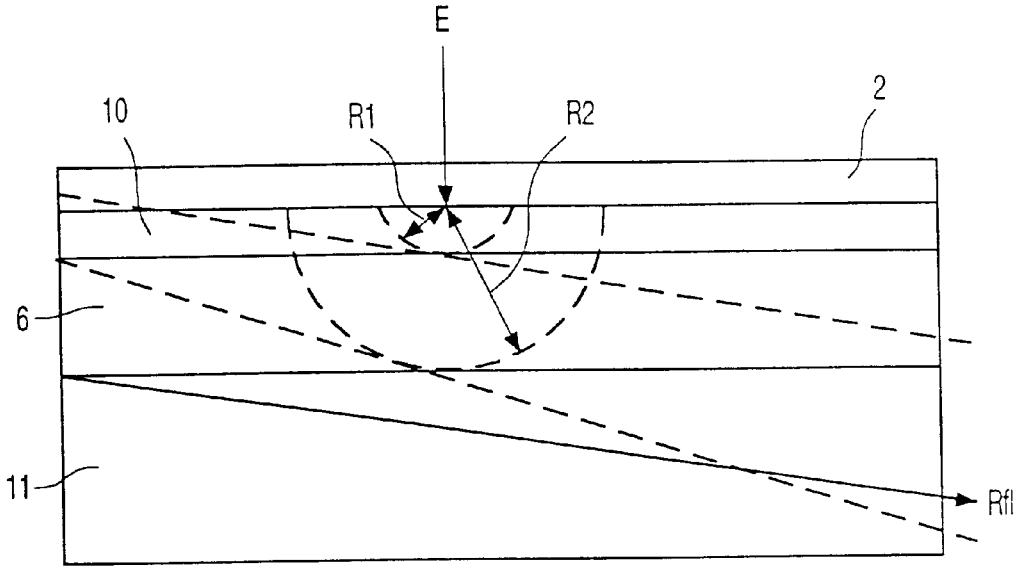
FIG. 3 is a diagrammatic sectional view of a first target arrangement.
Figure 4:
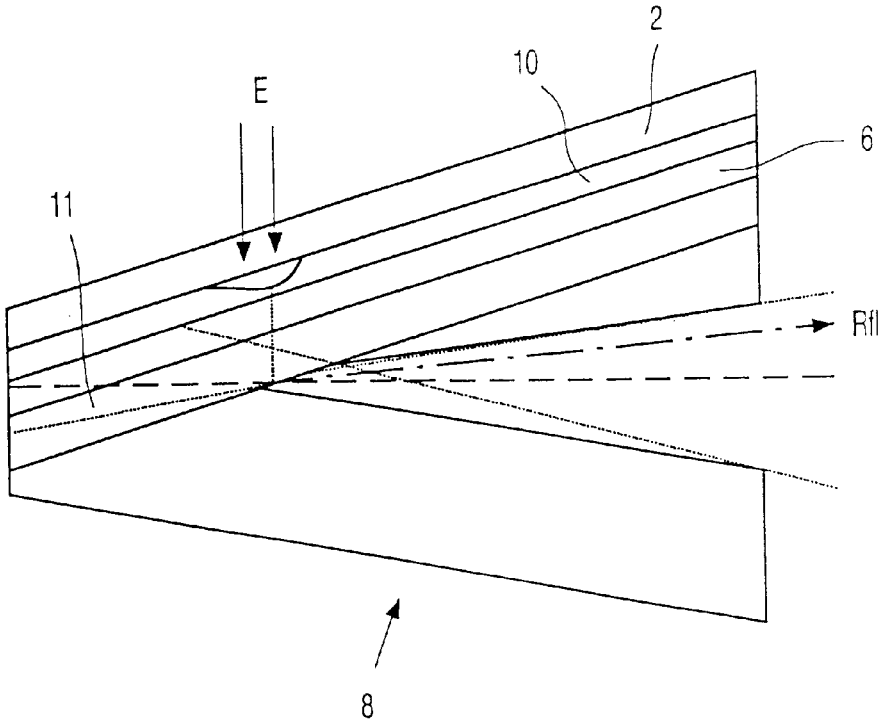
FIG. 4 is a diagrammatic sectional view of a second target arrangement.

Non-liquid metals (for example, gold) or metal alloys can also be used notably for the target arrangements shown in the FIGS. 3 and 4.

FIG. 3 is a diagrammatic sectional view of a first target arrangement in the form of a layer structure. The electron beam E is incident, via the first window 2, on the primary target 10 which serves as a converter and in which the X-rays are excited. The X-rays enter the secondary target 11 via the second window 6 and generate therein the substantially monochromatic fluorescent X-rays Rf1.

The operating principle is based on the following considerations: let it be assumed that the incident electron beam has the energy $E_0$ and that the energy of a (material-dependent) absorption edge K of the secondary target is $E_k$. While the electrons diffuse through the primary target 10, they produce X-rays in known manner (i.e. essentially Bremsstrahlung having a comparatively wide frequency spectrum) and lose energy while doing so. The thickness $R_1$ of the primary target, that is, the path length of the electrons through the primary target, is chosen in such a manner that the following condition is approximately satisfied:

$$R_1=(E_0-E_k)\Delta X/\Delta E,$$

this thickness being shown as the radius $R_1$ around the point of entry of the electron beam E in the primary target in FIG. 3.

In this equation $\Delta E/\Delta X$ means the mean energy loss of the electrons per unit of path length over the energy interval $E_0-E_k$. The electrons having traversed the primary target, or having traveled the path length $R_1$, now have the energy $E_k$ only and hence can no longer generate Bremsstrahlung having an energy larger than $E_k$ in the secondary target 11. Because this energy corresponds to an absorption edge of the secondary target, absorption of the relevant X-rays takes place therein as well as an excitation of higher energy states whose return to the basic state produces the characteristic radiation (monochromatic X-ray line, fluorescent X-rays).

When the path length through the primary target is essentially shorter than the value $R_1$ calculated by means of the above equation, the intensity of the X-rays produced will be proportionally less. When the path length is significantly longer, a larger part of the electrons will be converted into X-rays, but these rays will be absorbed again in the primary target before they can reach the secondary target. Therefore, the intensity of the monochromatic X-rays is very low in both cases.

The thickness of the secondary target, being represented by the radius $R_2$ around the point of entry of the electron beam into the primary target in FIG. 3, is chosen to be such that the intensity of the fluorescent X-rays is as high as possible. A maximum value is reached when the following condition is satisfied:

$$R_2-R_1=1/\mu$$

wherein $\mu$ represents the linear attenuation coefficient for X-rays in the secondary target. The photon energy, calculated at $\mu$, should amount to approximately $(E_0-E_k)/2$.

The monochromatic fluorescent X-rays generated in the area of the secondary target which is proportioned in conformity with the above equation should be read out at an angle for which the disturbing effect of Bremsstrahlung from the primary target, having the path length $R_1$, is as small as possible. Optimum suppression of this Bremsstrahlung can be observed when the fluorescent material itself serves as a radiation filter for this radiation. This is so when the X-ray beam Rf1 is read out at a comparatively small angle relative to the plane of the primary target. Such a direction is indicated in FIG. 3.

In order to achieve a further improvement of the spectral purity and a further reduction of the Bremsstrahlung spectrum present in the fluorescent X-rays spectrum, the second target arrangement shown in FIG. 4 can provide an increased filter effect.

The electron beam therein is then again transmitted by the first window 2 so as to be incident on the primary target 10 which may be a liquid or solid metal or a metal alloy. The X-rays produced enter the secondary target 11 via the second window 6. The excited monochromatic fluorescent X-rays Rf1 are stopped via the device 8.

The device 8 consists of a material which is essentially non-transparent to the X-rays and has a high atomic number. The funnel-like opening in the material, being constricted in the direction of the secondary target and its main axis enclosing an angle of between approximately 65° and 90° relative to the direction of the incident electron beam, forms a beam only from radiation from the secondary target which has traveled a given path length.

The proportioning of the optimum path length is dependent on the relevant application of the X-ray source and always constitutes a compromise between maximum intensity of the monochromatic X-rays and its spectral purity, that is, the filter effect of the secondary target.

Figure 5:
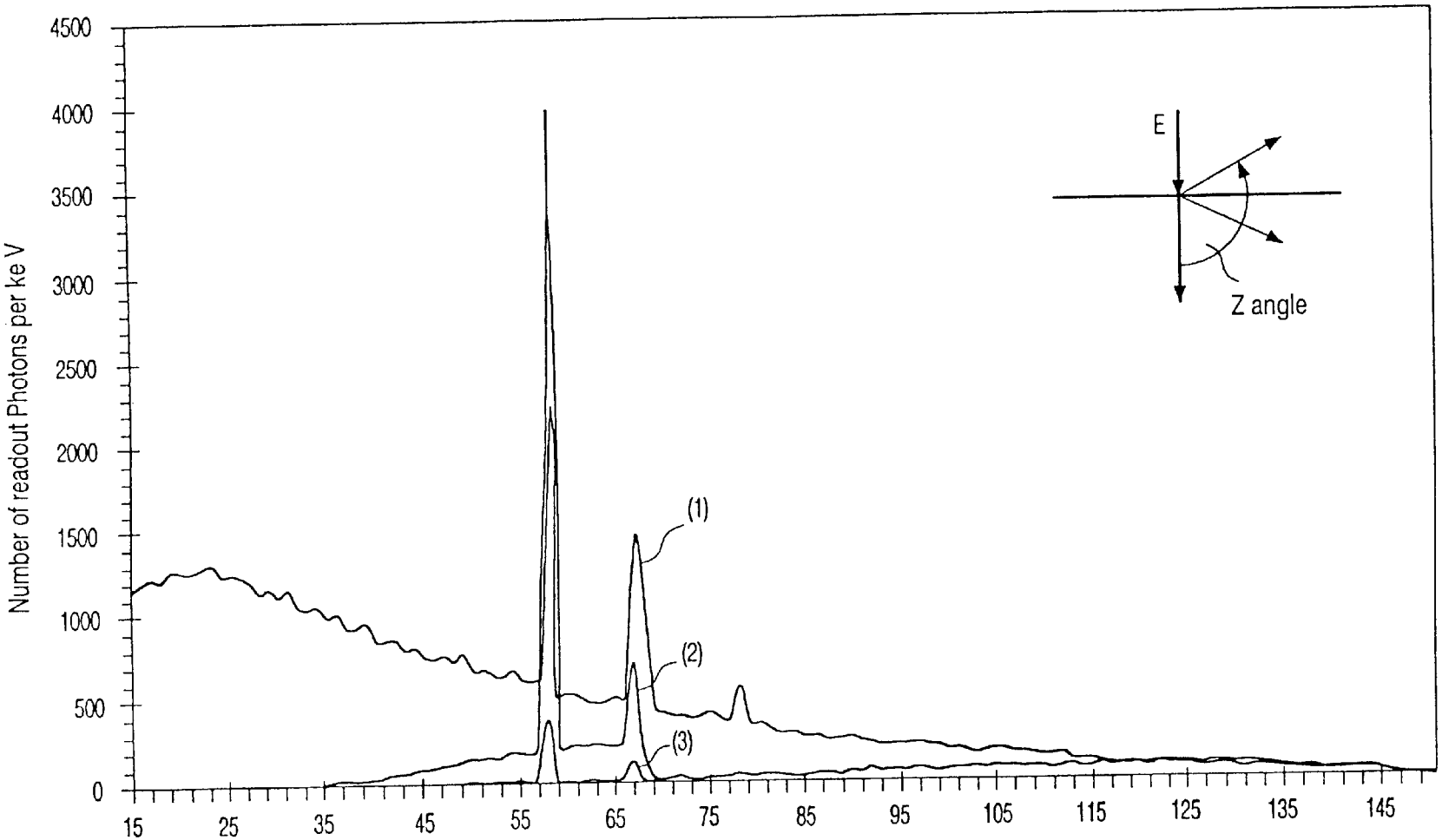
FIG. 5 shows graphically the spectral variations of the X-rays for different read-out angles.
Figure 6:
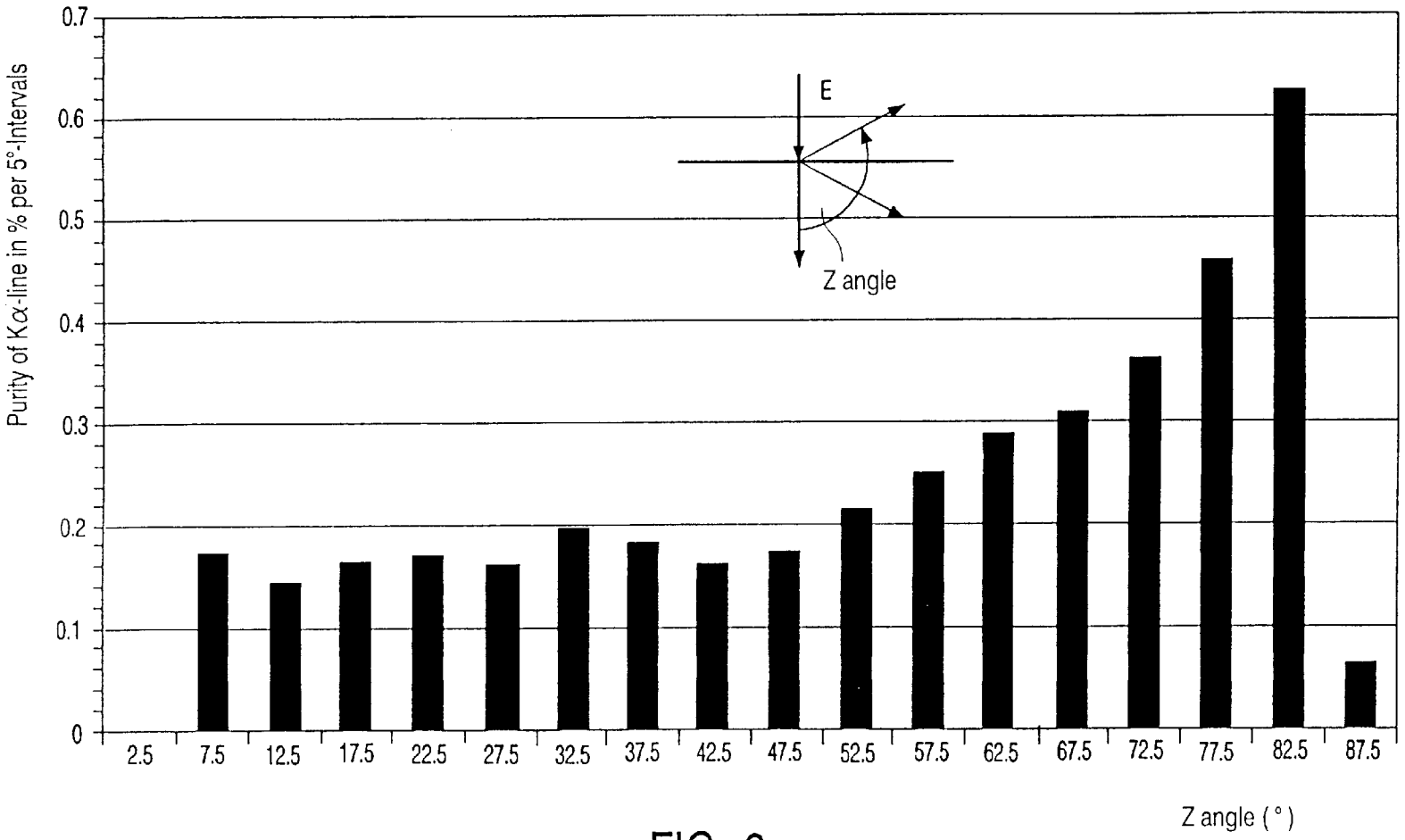
FIG. 6 shows graphically the spectral purity of an X-ray line in dependence on the read-out angle.

These relationships are graphically shown in the FIGS. 5 and 6, that is in both Figures for a target arrangement consisting of a primary target of gold of a thickness of 5 $\mu$m, a diamond window of a thickness of 195 $\mu$m, and a secondary target of tantalum of a thickness of 150 $\mu$m, an electron beam E of an energy of 150 keV being incident on the primary target.

FIG. 5 shows the energy spectra of the monochromatic fluorescent X-rays read out at different angles, that is, the curve (1) in reflection for a Z angle of from 90 to 180 degrees, the curve (2) in transmission for a Z angle of from 0 to 90 degrees, and the curve (3) in transmission for a Z angle of from 65 to 90 degrees. In the representation of the FIGS. 5 and 6 the Z angle extends between the direction of incidence of the electron beam and the read-out direction.

The curve (1) shows the customary course in known X-ray tubes which exhibit two distinct frequency lines, but also have a significant Bremsstrahlung spectrum above and below these lines. The curve (2), however, shows a clearly reduced Bremsstrahlung spectrum and frequency lines of slightly reduced intensity only, whereas the curve (3) is characterized by an extremely high spectral purity, be it at the expense of a significantly reduced intensity of the two frequency lines. Notably the curve (2), however, constitutes an attractive compromise between high spectral purity and an only slightly reduced intensity of the monochromatic X-rays; this compromise is advantageous for many applications and has not yet been achieved by the state of the art.

FIG. 6 illustrates the purity of the spectral monochromatic X-rays (K$\alpha$ line) percents per 5 degree intervals in dependence of the Z angle. These measurements have yielded distinct maximum at a Z angle of 82.5 degrees.

What is claimed is:

1. An X-ray source for generating substantially monochromatic fluorescent X-rays with a primary and a secondary target, characterized in that the primary target (10) is a liquid metal or a liquid metal alloy which is conducted between a first window (2) being transparent to an electron beam, and a second window (6), being transparent to X-rays and adjoined by the secondary target (11), in such a manner that the electrons which are incident on the primary target via the first window produce X-rays which exhibit, upon reaching the secondary target, essentially a maximum energy which corresponds to an absorption edge of the secondary target so that substantially monochromatic fluorescent X-rays are excited in the secondary target.

2. An X-ray source as claimed in claim 1, characterized in that at least one of the two windows (2; 6) is a diamond window.

3. An X-ray source as claimed in claim 1, characterized in that the liquid metal or the liquid metal alloy is conducted between the first and the second window (2; 6) in a turbulent flow.

4. An X-ray source as claimed in claim 1, characterized in that it includes a device (8) for forming a monochromatic X-ray beam which has traveled a mean path length through the secondary target (11) in such a manner that an as large as possible part of the Bremsstrahlung from the primary target (10) is absorbed by the secondary target.

5. An X-ray source as claimed in claim 4, characterized in that the device (8) is formed by an X-ray shield provided with a funnel-shaped opening on a free surface of the secondary target (11) which is constricted in the direction of the secondary target and whose main axis encloses an angle of from approximately 65° to 90° relative to the direction of the incident electron beam (E).

* * * * *